United States Patent [19]

Kegelman et al.

[11] Patent Number: 4,839,673

[45] Date of Patent: Jun. 13, 1989

[54] AC CORONA ENHANCEMENT FOR ELECTROSTATIC IMAGING DEVICES

[75] Inventors: Thomas D. Kegelman, Palm Harbor, Fla.; Michael W. Raymond, Bolton, Conn.

[73] Assignee: Moore Business Forms, Inc., Grand Island, N.Y.

[21] Appl. No.: 131,760

[22] Filed: Dec. 11, 1987

[51] Int. Cl.[4] ..... G03G 21/00

[52] U.S. Cl. ..... 346/160.1; 355/276

[58] Field of Search ..... 355/3 R, 3 TR, 3 CH; 346/153.1, 155, 160.1; 430/97, 126

[56] References Cited

U.S. PATENT DOCUMENTS

| | | | |
|---|---|---|---|
| 4,039,257 | 8/1977 | Connolly | 355/3 R |
| 4,264,912 | 4/1981 | Coburn et al. | 346/161 |
| 4,402,591 | 9/1983 | Nakahata | 355/3 TR |
| 4,423,354 | 12/1983 | Kegelman | 315/12.1 |
| 4,638,339 | 1/1987 | Coburn et al. | 346/153.1 |
| 4,642,661 | 2/1987 | Dean, II | 346/145 X |
| 4,651,605 | 3/1987 | Dean, II | 83/209 |
| 4,701,042 | 10/1987 | Mimura et al. | 355/3 DD |

*Primary Examiner*—Arthur T. Grimley
*Assistant Examiner*—J. Pendegrass
*Attorney, Agent, or Firm*—Nixon & Vanderhye

[57] ABSTRACT

The image receiving surface of a non-impact image printer such as an electrographic printer is treated with an AC corona just prior to image transfer to paper or the like thereby to suppress transfer of non-image background toner and edge effect toner thereby to enhance the transferred image.

18 Claims, 3 Drawing Sheets

AC CORONA ENHANCEMENT FOR ELECTROSTATIC IMAGING DEVICES

FIELD OF THE INVENTION

This invention generally relates to non-impact imaging devices and is particularly directed to apparatus of the toner transfer type for enhancing image formation on paper by suppressing transfer of unwanted non-image forming toner.

BACKGROUND OF THE INVENTION

Non-impact printers often employ apparatus to form latent electrostatic images on a suitable surface, which surface with its latent image electrostatic charge attracts toner from a developer station and subsequently transports the toner image to a transfer station where the toner is transferred to paper. In accordance with normal conventional techniques, the toner particles themselves are inductively or triboelectrically charged to a potential opposite to that of the latent image and close to the potential of the background of the image so that, ideally, the toner will adhere electrostatically to the image and not to the background surface. Such techniques are common in xerography and in electrographic printing as shown by U.S. Pat. No. 4,638,339 and U.S. Pat. No. 4,642,661, both of which are assigned to the assignee of the present invention.

A commonly used technique for transferring the image to the paper is to expose the back side of the paper to the field of a corona the polarity of which is opposite to that of the toner that adheres to the image with transfer of the image taking place when the paper is in contact with the image surface so that the charge on the paper attracts the toned image to the paper which thereafter is fixed to the paper as, for example, is described in the aforementioned U.S. Pat. No. 4,642,661.

Under ideal conditions the development process will faithfully reproduce the electrostatic charge pattern of the image and the transfer of the tone image would be relatively simple, the objective being to transfer as much of the toner as is possible while maintaining the quality of the image.

Such conventional techniques of developing the image have resulted in the identification of two basic problems. One such problem is presented by creation of a background that is less than "clear" because some of the toner particles adhere to the surface on which the latent image is formed—even in areas where no electrostatic image is present. That toner ends up being transferred to the paper as background clutter so as to detract from the quality of the printed page. A second problem results from the action of the charged toner particles themselves which tend to be attracted to the edges of the latent electrostatic image thereby creating unequal image density and even some loss of edge definition. Attempts have been made to control the image signal field strength - namely, the white-black field difference—such that the background collection of spurious toner particles is limited; but unfortunately such a technique generally limits the density of the image itself.

OBJECTS OF THE INVENTION

It is a principal objection of this invention to provide improved apparatus and methods for use in non-impact image printers to treat the image receiving surface thereby to minimize background printing clutter transferred to the paper surface and, at the same time, to reduce image edge imprecision.

It is a further object of this invention to provide improved apparatus for treating the image receiving surface of a non-impact printer after a latent image has been formed with toner applied to that surface but before transfer of the toner image to the paper surface.

It is another object of the invention to provide improved apparatus for use in a non-impact image printer for depositing a zero net electrostatic charge on the charge receiving surface after the latent electrostatic image has been treated with toner but before transfer of the toner image to paper so as to suppress toner transfer to the paper where such toner is not directly on the latent electrostatic image.

It is an additional object of the invention to provide apparatus for enhancing the transfer charge on a charge receiving surface thereby to suppress transfer of background toner particles.

It is still a further object of this invention to provide improved apparatus for use with electrographic printing apparatus wherein a latent printing image is provided on a tensioned belt dielectric surface for development with toner wherein non-image toner particles are substantially precluded from transfer to the paper surface.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the various ways in which the principles of the invention are employed.

SUMMARY OF THE INVENTION

The present invention in its simplest form provides a charge transfer endless-loop dielectric belt wherein the image surface of the belt of an electrographic printer is exposed to the field of an AC corona after a latent image has been formed and toner has been applied to the latent image but before the toned, latent image enters the transfer station wherein the toner is transferred to a suitable surface such as paper, the AC corona serving to suppress the transfer of all toner that is not directly on the toned electrostatic image. The present invention is equally suitable with a xerographic drum or other dielectric surfaces wherein a latent electrostatic image is formed and toner is attracted to that image for subsequent transfer to a developing station.

Also included within the invention is non-impact printing apparatus wherein the endless loop dielectric belt is constantly cleaned and conditioned prior to passing a multi-electrode print head which establishes a latent electrostatic image. That image is developed by a conventional toner imaging method, which image is thereafter provided with a pre-transfer corona treatment before the image is transferred to paper and fused.

DETAILED DESCRIPTION OF THE INVENTION

Figure 1:
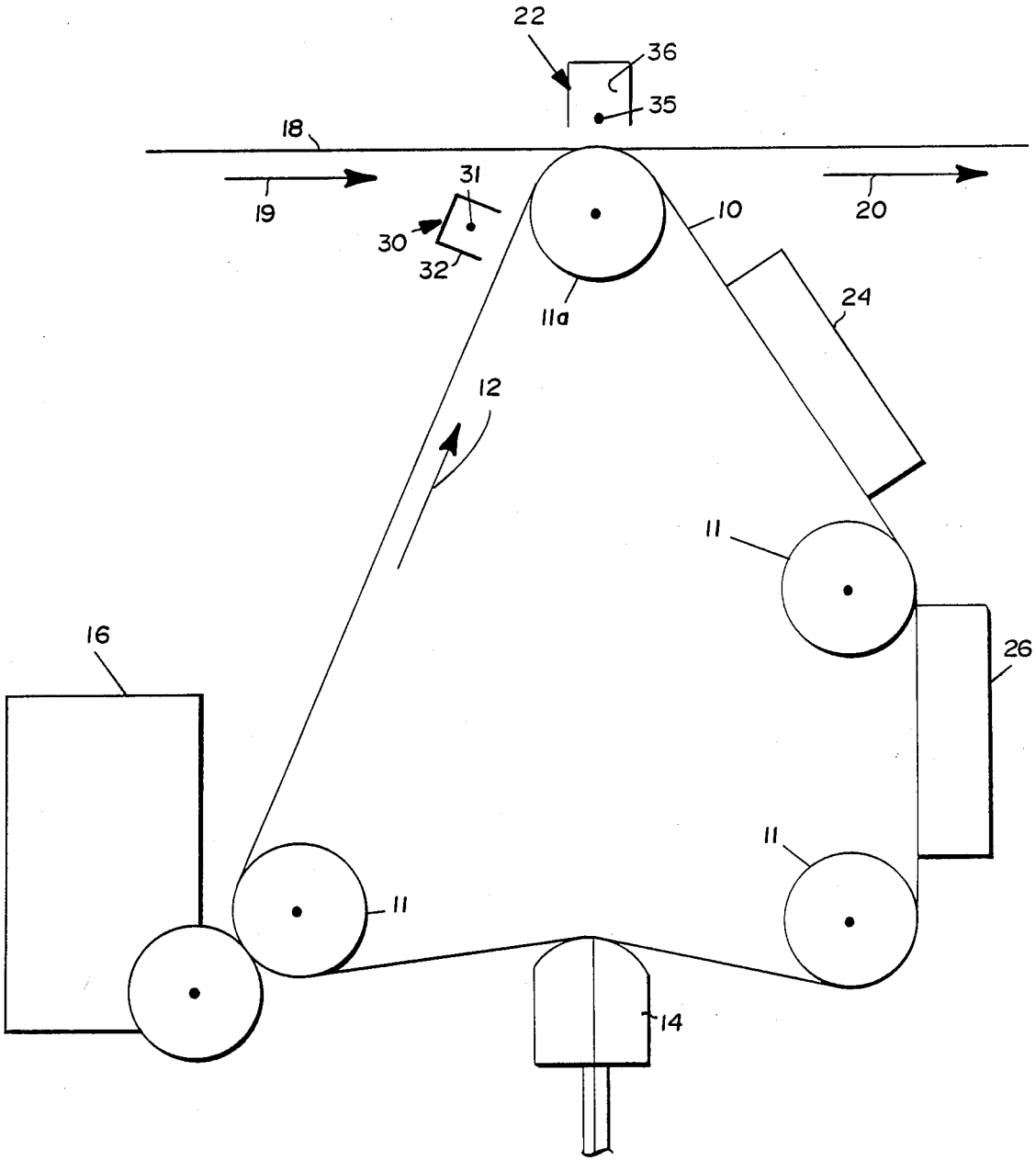
FIG. 1 schematically illustrates an electrographic printer including the image enhancement apparatus of the present invention.

Turning first to FIG. 1 and the schematic illustration of non-impact printer including the present invention in a preferred embodiment, a suitable dielectric image belt 10 such as that shown in co-pending application Ser. No. 07/131,828 entitled Belt and Belt Support Drive for Non-impact, Direct Charge Electrographic Printer and assigned to the assignee of the present invention, is supported on a plurality of rollers 11, one or more of which may be driven to produce movement of the belt 10 in the direction of arrow 12. The print head 14 of the preferred embodiment of this apparatus is preferably of the type disclosed in my U.S. Pat. No. 4,638,339 issued Jan. 20, 1987 and assigned to the assignee of the present invention, which print head serves to create on dielectric belt 10 a latent electrostatic image in accordance with the voltages applied to the pins of print head 14.

In accordance with conventional techniques, a suitable toner is supplied to belt 10 by developer apparatus generally designated 16, which toner is attracted in accordance with the electrostatic charge on belt 10. A continuous sheet of paper 18 is suitably driven in the direction of arrows 19 and 20 so as to pass roller 11*a*, which roller is directly opposite and supportive of belt 10 at transfer corona 22. After the image has been transferred to paper 18, the belt continues to cleaning station 24 which may be of the type disclosed in co-pending application Ser. No. 07/131,753 entitled Cleaning System for Non-impact Printer and assigned to the assignee of the invention. Following such cleaning, dielectric belt 10 continues through conditioning station 26 to prepare dielectric belt 10 to receive the image from print head 14, which conditioning station is preferably constructed in accordance with co-pending application Ser. No. 07/131,928 entitled Conditioning Apparatus for Non-impact, Direct Charge Electrographic Printer Belt and assigned to the assignee of this invention.

In accordance with conventional techniques, the paper with the image transferred thereto by the transfer corona 22, continues to a suitable image fixing or fusing station (not shown) which apparatus can be constructed in accordance with U.S. Pat. No. 4,642,661 entitled Printer with Drive on Swinging Platform and assigned to the assignee of the present invention.

It is common in the prior art directed to non-impact offset printing apparatus to employ electrostatic images formed on a dielectric belt such as belt 10 to attract toner from a suitable developer station 16. In accordance with such prior art technique, the toner at developer station 16 is inductively or triboelectrically charged to a suitable electrostatic potential opposite to that of the latent image formed on the electrostatic belt; preferably that potential is close to the electrostatic belt background potential so that most of the toner will be attracted to the image and not to the background areas.

To develop the image that has been toned, it is common to transfer the toned image to paper by providing a corona generating device such as 22 whose electrostatic polarity is established as being opposite to that of the toner which appears on the toned image of the belt 10 that such toner is attracted to paper 18 while the paper is adjacent transfer corona 22. The paper retains its charges and carries the image to a fusing station (not shown).

In an ideal system, the transfer process intended to reproduce the toned image would have as its goal a transfer of as much of the toner on electrostatic belt 10 as is possible. However as will be subsequently pointed out in greater detail, some of the toner will adhere to belt surfaces in areas where no electrostatic image is present such that background clutter and image degradation is presented on paper 18 when the image is fused to the paper. Additionally toner tends to be attracted to the edges of the electrostatic image thereby causing a loss of edge definition to further reduce print quality.

By way of explanation, applicants use the term "corona" in a generic sense to refer to a fairly wide variety of commercially available corona discharge devices as well as devices which generate or produce ions which are characteristic of a corona. The specific details of the corona generation or production of ions is not an essential part of the invention and hence applicants use the generally accepted term "corona" in connection therewith.

In accordance with the improvements of the present invention, the image to be transferred from belt 10 to paper 18 is enhanced by providing an alternating current pre-transfer corona 30. Corona 30 is shown as generally comprising the conventional corona wire 31 partially surrounded by a U-shaped housing 32 suitably supported and opened at that portion of the wire 31 facing belt 10. It is to be noted that corona 30 is connected to a suitable AC voltage source as for example 8 KV AC voltage (power supply not shown) which wire 31 and housing 32 are supported adjacent to belt 10 in the region of support of belt 10 by roller 11*a* a and juxtaposed to the underside of paper 18 as close to the transfer corona 22 as is appropriate. It must be kept in mind that corona wire 35 of transfer corona 22 and its enclosure 36 are generally similar in construction and suitably supported close to the back surface of paper 18 and energized from a direct current potential of approximately 6 KV to effect transfer of the toner particles of the image from belt 10 to paper 18.

Figure 2:
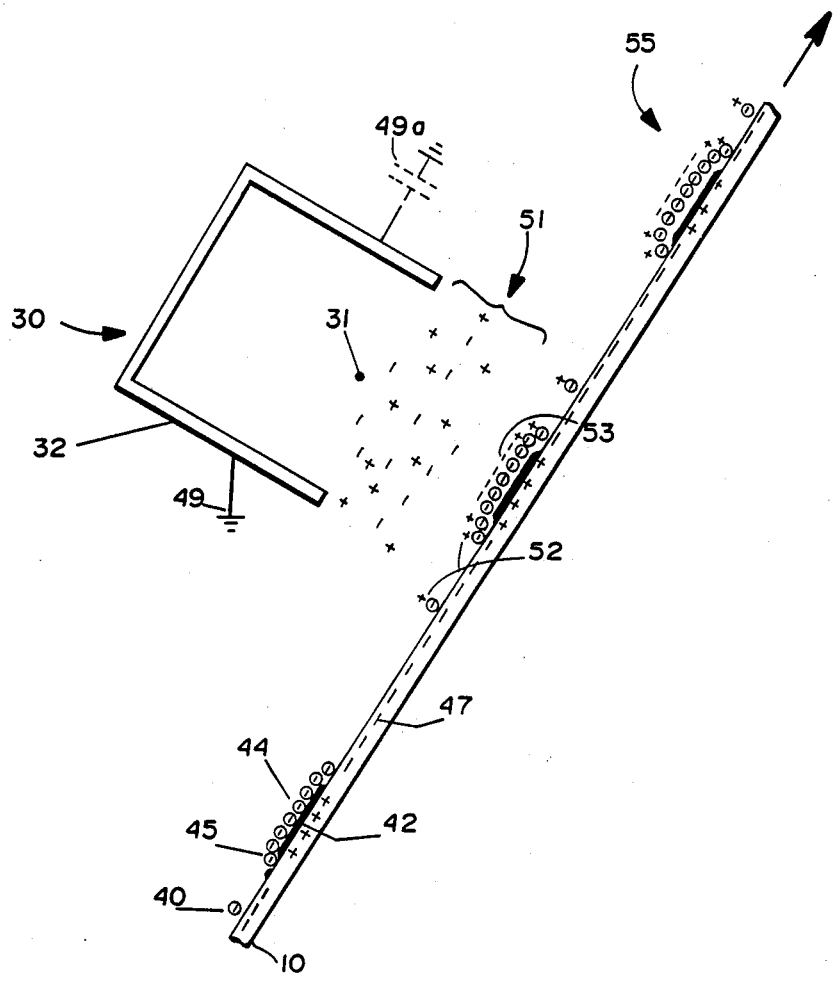
FIG. 2 is a schematic illustration of a portion of a dielectric belt showing, with exaggerated symbolism, the charge distribution of the belt and the effect of the alternating current corona of the present invention.

To more fully understand the present invention, FIG. 2 is provided to illustrate the belt 10 and pre-transfer corona 30 including corona wire 31 and housing 32, the remainder of the structure being omitted for purposes of clarity.

Belt 10 is shown by exaggerated indicia, as having toner on the background of the image as at 40, a positive electrostatic image at 42, toner on the main image portion as at 44 and edge developed toner as at 45. In accordance with the present apparatus, a negative background voltage extends throughout this portion of belt 10 as shown by the numeral 47.

However, the polarity of the toner image and the background voltage is a matter of choice but must be opposite in electrical charge.

In accordance with the present invention, corona wire 31 is provided with an 8 KV (RMS) AC voltage energization with the corona shell 32 being connected to ground as at 49. A cloud of both negative and positively charged ions is produced by the AC corona as generally illustrated at 51 with positive ions being attracted to the negative background as shown at 52 and negative ions being attracted to the positive image as shown at 53. The ions from the AC corona are attracted to opposite potentials in areas on the belt without significantly altering the average potential of the belt such that the positive ions attach to the toner in the negative background area and at the edge developed area to, in effect, suppress the toner particles in these areas whereas negative ions attach to the toner at the positive image area to thereby enhance the transfer of toner to the paper as described below. As that image is brought to the region of the transfer corona 22 (see FIG. 1) the field of positive ions produced by the transfer corona wire 35 (which generally operates at a 6 KV positive potential) causes the paper to be charged to a positive potential as well. As the toner generally shown at 55 on the image belt is attracted to the paper, those toner particles that carry a positive charge as a result of exposure to the pre-transfer corona 30 are repelled by the positive charge on the paper and the toner particles that generally carry a negative charge are attracted to the paper; ideally, only image toner is transferred to the paper. The toner that attaches to the background and to the edge development areas remains on the belt 10 for subsequent removal from the belt surface at the cleaning station 24.

Figure 3:
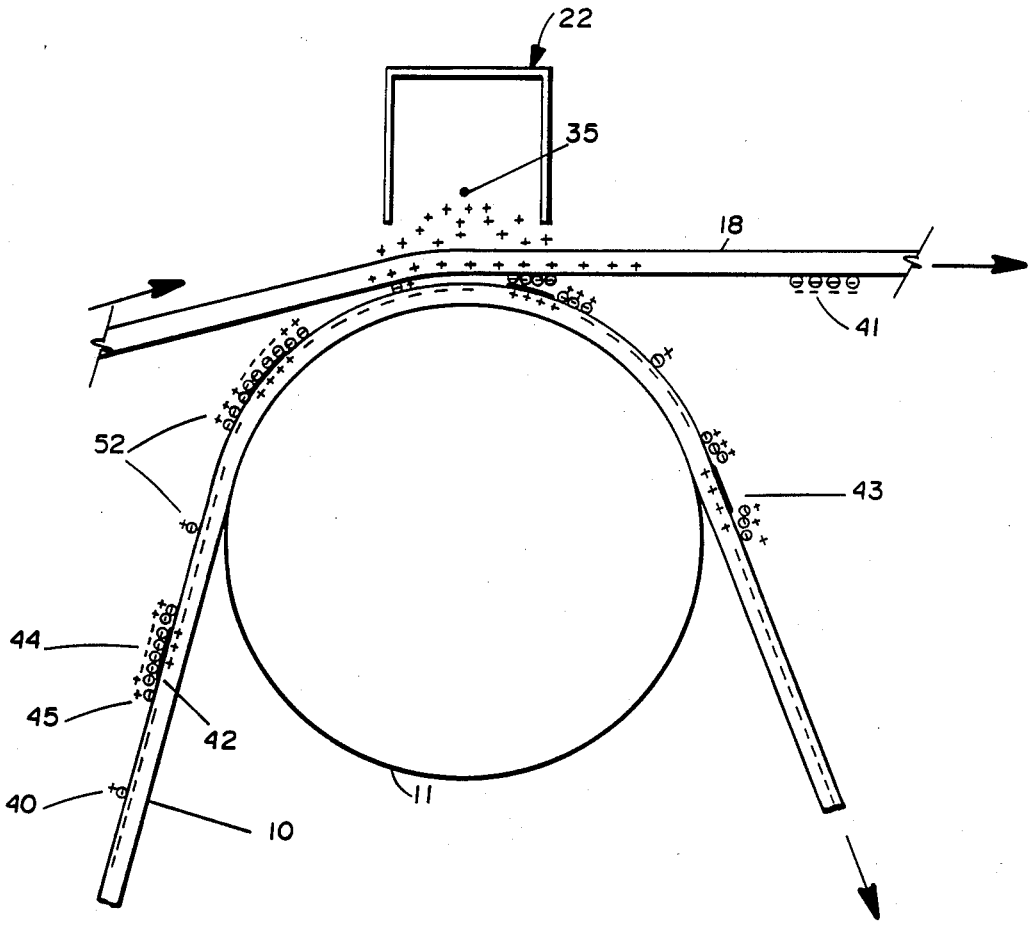
FIG. 3 is a schematic illustration with exaggerated charge symbolism of the dielectric belt at the moment that the paper and charged belt move synchronously in the area of the transfer corona.

Referring next to FIG. 3, the foregoing toner transfer action is more clearly seen wherein the desired image 41 is formed on paper 18 by virtue of its positive charge created by transfer corona 22 with the unwanted background clutter and edge toner 43 remaining on belt 10 as it proceeds to the cleaning station.

If desired, the normally grounded shell of pre-transfer corona 32 can be connected to ground through a suitable capacitor (0.01 microfarad, 1000 volt) in recognition of the fact that negative ions are more mobile than positive ions and hence there tends to be a negative charge on the belt as it exits the area under the pre-transfer corona; such a net negative charge can cause a decrease in transfer efficiency at transfer corona 22. The shell connection to ground through a capacitor (see dotted lines at 49*a* of FIG. 2) permits the corona to self-bias such that the capacitor will assume the offset potential necessary to provide a substantially equal number of positive and negative ions thereby to minimize the possibility of a net change in belt electrostatic voltage as it passes the pre-transfer corona.

The apparatus and method of this invention whereby an AC corona of suitable voltage is positioned to treat the dielectric belt and positioned immediately prior to the transfer station of an electrostatic printer achieves significant improvement in the image quality transferred to paper by suppressing the transfer of background clutter toner and edge attracted toner.

As will be apparent to persons skilled in the art, various modifications, adaptations and variations of the foregoing specific disclosure can be made without departing from the teachings of this invention.

Having thus described the invention what is claimed is:

1. In a non-impact printer wherein a latent electrostatic image is developed with toner for transfer to paper, apparatus for suppressing image background clutter while improving image edge definition upon transfer to paper comprising:

an electrostatically charged surface for accepting toner to form a toned image;

means for moving said surface to a transfer station wherein the toned image is positioned to engage paper moving at the same speed as said surface;

means for moving the toned image from said surface to the paper; and means providing an alternating current corona at a point in travel of the toned image immediately prior to the location of said means for moving the toned image to the paper for suppressing toner particles in background areas of said surface and at the image edge while enhancing the transfer of toner particles directly on the image.

2. The printer of claim 1, wherein said alternating current corona extends completely across said surface.

3. The printer of claim 1 wherein said electrostatically charged surface is an endless dielectric belt.

4. The printer of claim 1 wherein the alternating current corona creates an ion cloud comprised of a substantially equal number of positive and negative ions which do not significantly alter the average potential of the moving imaging surface.

5. The printer of claim 1 wherein the means for moving the toned image from the moving surface to the paper is a corona disposed adjacent the side of the paper opposite the toned image and charged opposite to the toner charge thereby to produce an electrostatic charge on the paper attracting the toned image to the paper.

6. In a non-impact printer wherein a latent electrostatic image is developed with toner for transfer to paper, apparatus for suppressing image background clutter while improving image edge definition upon transfer to paper comprising:

an endless flexible dielectric member, means for forming an member, electrostatically charged latent image on the surface of said dielectric member for accepting toner to form a toned image;

means for supporting said member and for moving said member to move the toned image to a transfer station wherein the toned image is positioned to engage paper moving at the same speed as said dielectric member;

means for moving the toned image from said surface to the paper; and means providing an alternating current corona at a point in travel of the toned image immediately prior to the location of said means for moving the toned image to the paper, for suppressing toner particles in background areas of said surface and at the image edge while enhancing the transfer of toner particles directly on the image.

7. The printer of claim 6 wherein the alternating current corona creates an ion cloud comprised of a substantially equal number of positive and negative ions which do not significantly alter the average potential of the moving imaging surface.

8. The printer of claim 6 wherein said alternating current corona extends across to the entire moving dielectric member.

9. The printer of claim 6 wherein the alternating current corona comprises:

a corona wire extending across the dielectric member;

a partial shell extending about said corona wire, said shell being open in the region facing the dielectric member; and means connecting said shell to ground through a capacitor.

10. The printer of claim 9 wherein the alternating current corona creates an ion cloud comprised of a substantially equal number of positive and negative ions which do not significantly alter the average potential of the moving imaging surface.

11. The printer of claim 10 wherein the means for moving the toned image from the moving surface to the paper is a corona disposed adjacent the side of the paper opposite the toned image and charged opposite to the toner charge thereby to produce an electrostatic charge on the paper attracting the toned image to the paper.

12. The method of suppressing image background clutter while improving image edge definition in a non-impact, electrographic printer comprising the steps of:

(a) forming a latent electrostatic image on a moving dielectric member having an electrostatic background potential, (b) developing the latent image by permitting toner particles to be attracted to and adhere to the moving dielectric member;

(c) applying across said moving dielectric member an alternating current corona comprised of a substantially equal number of positive and negative ions at or near the electrostatic background potential of the moving member so that toner particles in background areas of said dielectric member, at the image edge are suppressed while enhancing the transfer of toner particles on the image; and (d) transfering the developed and toned latent image to paper immediately after the application of said alternating current corona.

13. The method of claim 12 wherein the step of transferring the toned image to paper is electrostatically achieved.

14. In a direct charge deposition, non-impact printer wherein a latent electrostatic image is developed with toner for transfer to paper, apparatus for suppressing image background clutter while improving image edge definition upon transfer to paper comprising:

a directly charged dielectric surface for accepting toner to form a toned image;

means for moving said surface to a transfer station wherein the toned image is positioned to engage paper moving at the same speed as said surface;

means for moving the toned image from said surface to the paper; and means for providing an alternating current corona at a point in travel of the toned image immediately prior to the location of said means for moving the toned image to the paper for suppressing toner particles in background areas of said surface and at the image edge while enhancing the transfer of toner particles directly on the image.

15. The printer of claim 14, wherein said alternating current corona extends completely across said surface.

16. The printer of claim 14 wherein said directly charged dielectric surface comprises an endless dielectric belt.

17. The printer of claim 14 wherein the alternating current corona creates an ion cloud comprised of a substantially equal number of positive and negative ions which do not significantly alter the average potential of said surface.

18. The printer of claim 14 wherein the means for moving the toned image from the moving surface to the paper is a corona disposed adjacent the side of the paper opposite the toned image and charged opposite to the toner charge thereby to produce an electrostatic charge on the paper attracting the toned image to the paper.

* * * * *